United States Patent [19]

Fitzgerald et al.

[11] 4,061,940

[45] Dec. 6, 1977

[54] BASELESS CARTRIDGE LAMP AND SOCKET THEREFOR

[75] Inventors: James J. Fitzgerald, Kinnelon; Joseph J. Fortunato, Livingston; Nickolas P. Demas, Cranford, all of N.J.

[73] Assignee: Wagner Electric Corporation, Parsippany, N.J.

[21] Appl. No.: 672,266

[22] Filed: Mar. 31, 1976

[51] Int. Cl.[2] ..... H01J 5/48; H01J 5/50

[52] U.S. Cl. ..... 313/318; 313/315; 339/52 R; 339/53; 339/56; 339/258 R

[58] Field of Search ..... 313/318, 315; 339/52 R, 339/52 S, 53, 54, 55, 56, 217 S, 217 TR, 220 L, 256 R, 258 R

[56] References Cited

U.S. PATENT DOCUMENTS

| | | | |
|---|---|---|---|
| 2,160,786 | 5/1939 | Peterson | 313/318 |
| 2,742,621 | 4/1956 | Pistey | 339/52 S |
| 3,125,299 | 3/1964 | Woofter et al. | 339/188 R |
| 3,633,149 | 1/1972 | Maltais | 339/52 R |

*Primary Examiner*—Saxfield Chatmon, Jr.
*Attorney, Agent, or Firm*—Eyre, Mann, Lucas & Just

[57] ABSTRACT

A dual filament lamp is installed in its cooperating socket without the use of intermediate base, cement or bulb stem. The elimination of the intermediate elements improves the ability to manufacture lamps having precise filament alignment with respect to their sockets.

7 Claims, 9 Drawing Figures

BASELESS CARTRIDGE LAMP AND SOCKET THEREFOR

BACKGROUND OF THE INVENTION

Conventional dual-filament lamps, of the type customarily used in automotive tail/stop lamps are assembled by bonding an envelope over a glass stem which has been preassembled with filament and leads. The envelope/stem subassembly is then cemented into a base. The completed assembly is then installed in a socket in the vehicle.

As each of the above interfaces is formed, the opportunity exists for geometric misalignment of the filaments with respect to the socket. The individual misalignments are cumulative.

The prior art fails to teach a lamp which eliminates the intermediate base, cement and stem ordinarily used and provides orienting means.

SUMMARY OF THE INVENTION

The present invention consists of a novel lamp and a cooperating socket therefor. The lamp is connected to the socket using external extensions of the filament support pins. By eliminating the separate stem and base found in the conventional lamp, this invention reduces the opportunities to develop errors in filament alignment as well as reducing production cost and complexity.

The cooperating socket retains the lamp in position. The geometry of the socket and lamp are such that the lamp can be installed only one way. This ensures the connection of each filament to the desired power source and fixes the location of each filament with respect to the socket. One embodiment discloses end-to-end symmetry which allows two coordinate mounting positions each of which places each filament in its correct location.

DETAILED DESCRIPTION OF THE PREFERRED EMBODIMENT

Figure 1:
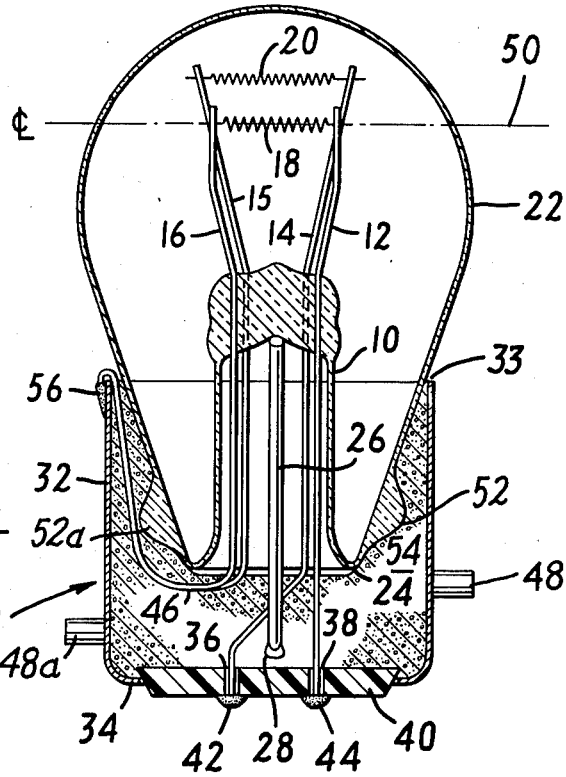
FIG. 1 PRIOR ART
FIG. 1 shows a view, in partial cross section, of a conventional automotive two-filament lamp.

In the prior art, multiple filament lamps are manufactured as shown in FIG. 1. A glass stem 10 is preassembled with a number of filament support pins, indicated in the figure by four filament support pins 12, 14, 15 and 16, hermetically sealed through it, a major filament 18 attached between filament supporting pins 12 and 16, as by welding, crimping or twisting and a minor filament 20 attached between filament support pins 14 and 15.

Filament support pins 15 and 16 can be combined into a single common support pin. The preassembly is then bonded into a glass envelope 22 using glass-to-glass fusion in an annular seal at 24. It is evident that mechanical misalignment can develop during this bonding operation. As will become evident, this misalignment is cumulative with misalignments which occur later in assembly.

The air is evacuated from the closed assembly and replaced by an inert gas preferably argon through a glass exhaust tube 26 which communicates with the interior. After this step, the end of the glass exhaust tube 26 is pinched off at 28 to provide a permanent seal.

The outer ends of filament support pins 12 and 14 are inserted through holes 36 and 38 in an insulating button 40 and retained therein by solder lumps 42 and 44. The two solder lumps 42, 44 provide electrical contact between the socket (not shown) and one end of the minor filament 20 and the major filament 18, respectively, when the lamp is installed. The outer ends of the remaining two filament support pins 15 and 16 are joined together and bent upward at 46 so that the two pins 15, 16 lie approximately parallel to the envelope 22.

The base, indicated generally at 30, consists of a cylindrical metallic shell 32 having an open top 33 and an annular, inward-directed flange 34 at the bottom. A pair of cylindrical locating pins **48, 48*a* projecting from the side of the shell 32 engage cooperating detented grooves in the socket (not shown). The proper locking of the locating pins 48, 48*a* into the socket detents is depended upon both to place the lamp center line 50** at the proper distance from the lamp reflector (not shown) and to fix the rotational angle of lamp about its axis.

The preassembled envelope 22 is inserted into the base 30. Guide bumps **52, 52*a* on the outside of the envelope 22 aid in centering the envelope 22 within the base 30. The insulating button 40 fits the opening in the flange 34 and the connected filament pins 15 and 16 extend upward through the top 33 of the base 30**.

Note that direct holding and positioning of the filaments 18 and 20 themselves are not possible in this assembly procedure. Instead, only the envelope can be manipulated. Any misalignment of the filaments 18, 20 with respect to the envelope 22 continues uncorrected by this assembly operation. The possible additional misalignments of the filaments 18, 20 with respect to the base 30 can include:

a. positioning the lamp center-line 50 above or below the required point because of insufficient or excessive penetration of the base, b. rotational errors due to incorrect angular positioning of the filaments 18, 20 with respect to the locating pin 48 and c. skew errors in which the axis of the envelope 22 is tilted with respect to the axis of the base 30.

The region between the base 30 and the envelope 22 is filled with cement 54 thereby securing the envelope and base together. The outer ends of the connected filament leads 15 and 16 are bent down over the top 33 of the base 30 and soldered to the base 30 at 56.

Figure 2:
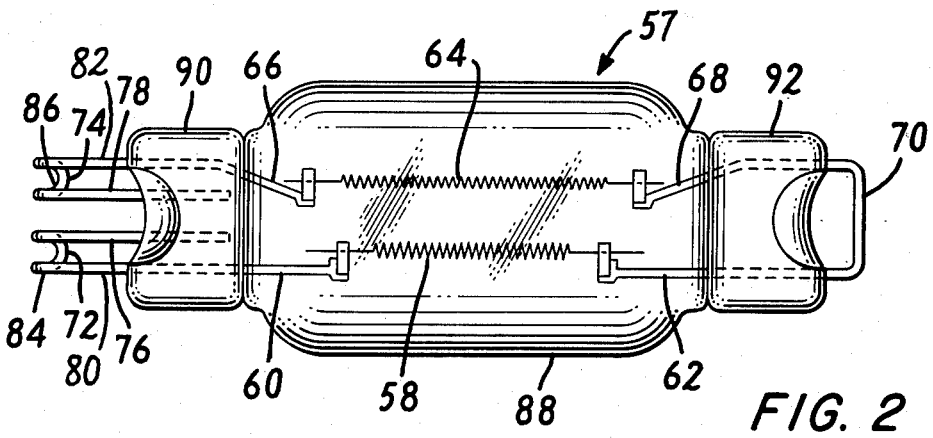
FIG. 2 shows a plan view of the lamp of the instant invention.

As shown in FIG. 2, the present invention eliminates the base, cement, locating pin, separate stem, and solder lump contacts of the conventional lamp. The new lamp, shown generally at 57 allows direct control of the filament positions with respect to the lamp mounting device during the entire assembly procedure. Thus the cumulative filament-positioning errors arising from the assembly operation of the conventional lamp are completely eliminated.

In the new lamp 57 a subassembly consisting of a major filament 58 attached to filament support pins 60 and 62, and a minor filament 64 attached to filament support pins 66 and 68 is rigidly held in a manufacturing jig (not shown). In the embodiment shown, filament support pins 62 and 68 are produced from a single continuous rod in which a square loop 70 is formed at its outside end. As will be explained later, the square loop 70 provides a part of the support for the new lamp 57 analogous to the function of part of the base 30 in the conventional lamp (see FIG. 1).

Filament support pins 60 and 66 contain reflex bends 72 and 74 respectively in their ends to form long hairpin shapes having return portions 76 and 78 running parallel to and spaced from the outgoing portions 80 and 82 of filament support pins 60 and 62. An outer portion 84 and 86 of each hairpin shape is bent about an axis lying normal to the axis of the lamp through an angle greater than 90° to form hooks.

Figure 3:
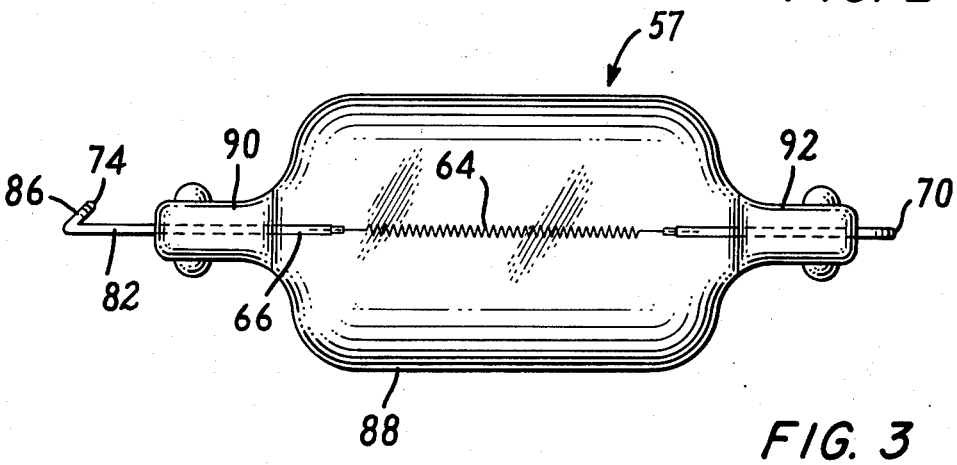
FIG. 3 shows the lamp of FIG. 2 rolled 90° about its longitudinal axis.

Referring momentarily to the view in FIG. 3, where the lamp has been rotated 90° about its axis, the two hooks formed by the two outer portions 86 and 84 (behind 86) are seen. The hooks are used in the mounting arrangement. As will be explained later, the hooks on the external portions of filament support pins 60 and 66 provide the remaining part of the support for the new lamp 57.

The filament/support-pin subassembly is rigidly clamped in a manufacturing jig (not shown) while the remaining assembly operations are performed. The geometric relationship between the filaments 58, 64 and the mounting points 70, 84 and 86 are thus fixed by direct external mechanical control which remains undisturbed until the lamp 56 is fully assembled.

A glass envelope 88 having reduced-diameter ends 90 and 92 is placed over the rigidly supported filament support-pin subassembly. As the reduced-diameter ends 90 and 92 are heated in an assembly machine of a type well known in the art, a purging flow of an inert gas, preferably argon, is passed into the envelope thereby displacing the air. When the reduced-diameter ends 90 and 92 are heated to the plastic state, they are pressed to a hermetic seal about filament support pins 62, 68, 60 and 66, and return portions 76 and 78 without deforming these parts. The plasticity of the glass allows a hermetic seal to be created without changing the positions of the two filaments 58 and 64 with respect to the external portions of the filament support pins. External support of the filament support pins 60, 62, 66 and 68 is continued until the glass has cooled sufficiently to become rigid. The glass thereafter rigidly supports both internal and external portions of the filament support pins 60, 62, 66, 68 in fixed spatial relationships to each other without need for continued external support.

Figure 4:
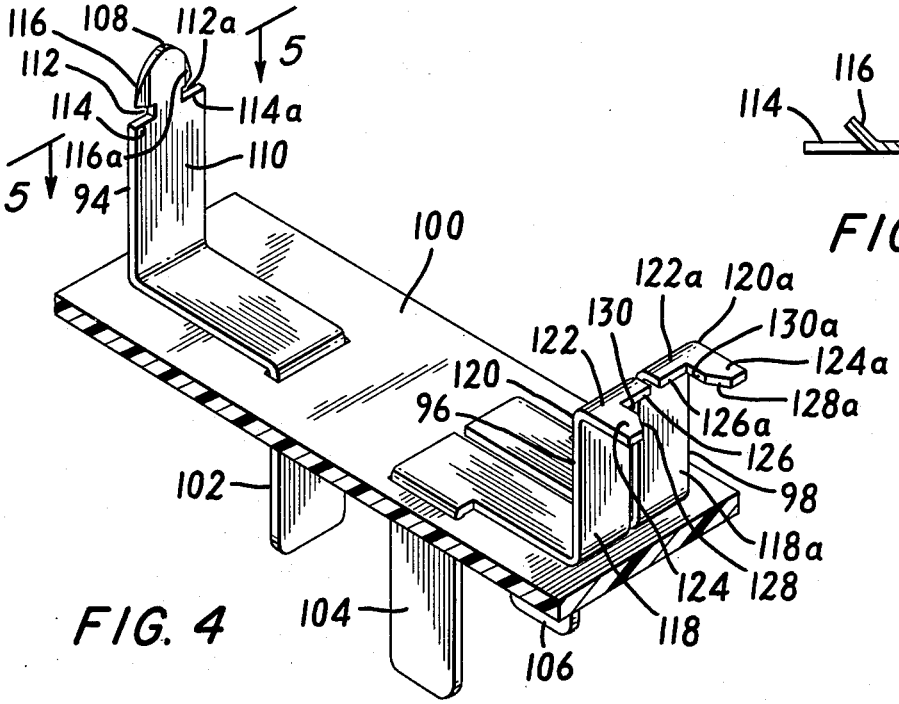
FIG. 4 shows a three-quarter view of a socket adapted to holding the lamp of the instant invention.

A socket, adapted to holding and supplying electrical power to the new lamp previously described, is shown in FIG. 4. Three socket pins 94, 96 and 98 extend upward from a base 100. The base 100 can be an integral part of a lamp fixture (not shown) or may be a separate piece mounted in a lamp fixture using screws or rivets. In the embodiment shown in FIG. 4, the base 100 is a separate piece adapted to mounting in a socket (not shown) using three lugs 102, 104 and 106. The lugs 102, 104 and 106 are electrically connected to the socket pins 94, 96 and 98 respectively and thus serve to provide electrical energy to the lamp. Other means of supplying electrical energy to the socket pins 94, 96 and 98, such as flexible wires, will occur to one skilled in the art.

Figure 5:
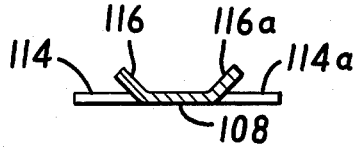
FIG. 5 shows a cross-sectional view along 5—5 of FIG. 4.

Socket pin 94 is adapted to hold the square loop 70 of the lamp 56. The outer end of socket pin 94 is shaped into an arc 108 having a maximum width of less than the width of the inner portion 110. Two notches 112 and **112*a* are cut at the base of the arc 108 creating two shoulders 114 and 114*a* at the outer end of the inner portion 110. Referring momentarily to the cross section of the arc portion 108 shown in FIG. 5, the lips 116 and 116*a* of the arc portion 108** are bent outward to form a latch.

Socket pins 96 and 98 are adapted to holding the hooked ends of support pins 60 and 66 and providing electrical energy thereto. Socket pins 96 and 98 have inner portions 118 and **118*a* extending parallel to each other outward normal to the base 100. The inner portions 118, 118*a* terminate at right-angle bends 120 and 120*a*. Outer portions 122 and 122*a* having tangs 124 and 124*a* and shoulders 126 and 126*a* extend laterally from the right-angle bends 120 and 120*a* all respectively. Guide bevels 128 and 128*a* and lateral shoulders 130 and 130*a* are located at the inner edges of the tangs 124 and 124*a*** respectively.

Figure 6:
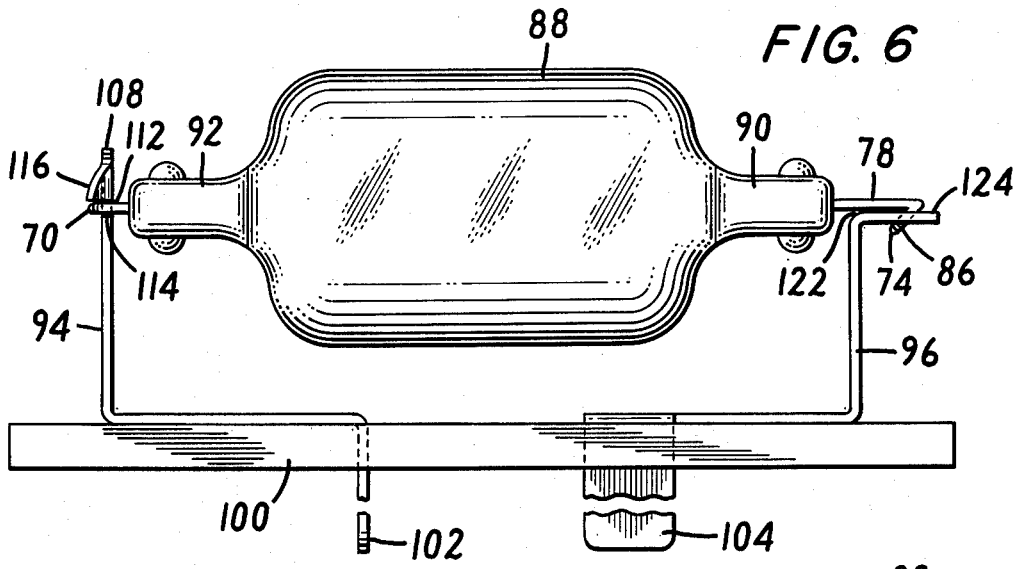
FIG. 6 shows a side elevation of the lamp mated to its cooperating socket.

The following description of the mating of the lamp and socket is written with reference to FIGS. 2, 4 and 6.

The two hooks on the outer portions 84 and 86 of support pins 60 and 66 are clipped over the outer portions 122 and **122*a* of socket pins 96 and 98 and come to rest against the shoulders 126 and 126*a*. Guide bevels 128 and 128*a* are conveniently provided to guide the hooks into the proper position. The spacing between lateral shoulders 130 and 130*a* snugly matches the outer dimensions of support pins 60 and 66** thereby rigidly fixing the lateral position of one end of the lamp.

In the unstressed condition, the spacing between the shoulders 126, **126*a* and the outer surface of socket pin 94 exceeds the distance between the corresponding bearing surfaces on the lamp. Thus, in order to settle the square loop 70 over the arc 108, the socket pin 94 is manually deflected inward. The square loop 70 then slides over the top of the arc 108, along the lips 116, 116*a* and comes to rest against shoulders 114 and 114*a*. The square loop 70 fits into the notches 112, 112*a* thus allowing the socket pin 94 to spring outward slightly as the square loop 70 clears the lips 116, 116*a*. The square loop thereafter remains captured in the notches 112, 112*a* by the lower edges of the lips 116, 116*a***.

The lamp is fully mated to the socket at this time. Since it is held in the socket by means of the same external portions of the filament support pins which were used to maintain alignment of the parts during manufacture, the precise positioning of the lamp filaments with respect to the socket is assured.

Figure 7:
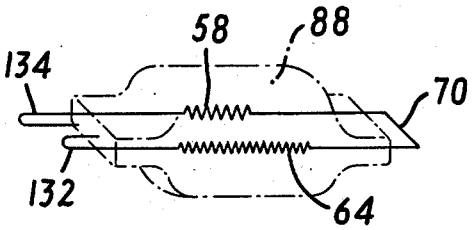
FIGS. 7, 8 and 9 show three alternate embodiments of the lamp in which the external portions of the support pins perform the same functions as the previous embodiments, but in which the shape of the external portions of the support pins are modified.
Figure 8:
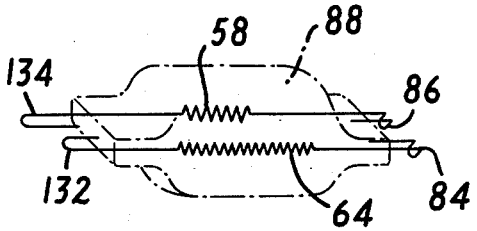
Figure 9:
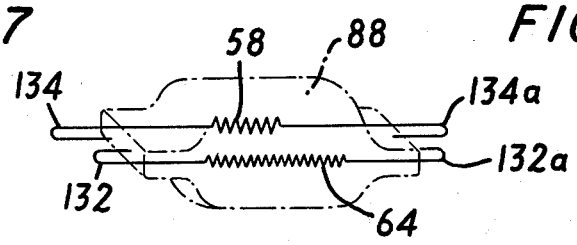

FIGS. 7, 8 and 9 show alternative embodiments of the lamp in which the external shape of the support pins is changed from the embodiment previously described. FIG. 7 discloses an embodiment which retains the square loop 70 at one end as previously described, but replaces the hooks of the previous embodiment with loops 132 and 134 of unequal length. This length inequality of loops 132 and 134 requires the installation in a socket (not shown) in a single geometric position.

FIG. 8 shows an embodiment containing hooks 84 and 86 at one end similar to those shown in FIGS. 2, 3 and 6 and with hooks 132 and 134 at the other end similar to those shown in FIG. 7. Hooks 132 and 134 can be of the same or different lengths because hooks 84 and 86 perform the orienting function as described for the first embodiment described.

FIG. 9 shows an embodiment having end-to-end symmetry. The loops 134 and 134*a* which are connected to the major filament 58 are longer than the two loops 132 and 132*a* which are connected to the minor filament 64. This length inequality ensures that each filament may be connected only to its own power source but allows end-to-end transposition of the loops.

The lamp alternative embodiments shown in FIGS. 7, 8 and 9 can be mounted in sockets (not shown) which utilize combinations of the elements of the socket embodiment shown in FIG. 6 or equivalents thereof. The lamp embodiment in FIG. 7 can be mounted on three pins similar to pin 94 in FIG. 6. The lamp embodiment of FIG. 8 can be mounted on a socket comprised of two pins similar to socket pins 96 and 98 at one end and two pins similar to pin 94 at the other. The lamp embodiment shown in FIG. 9 can be mounted on four properly spaced socket pins of the type shown at 94 in FIG. 6.

Although the preceding disclosure has been directed to a dual-filament lamp, it is obvious to one skilled in the art that the inventive concept may be adapted to a single-filament lamp or to lamps with more than two filaments without departing from the spirit of the invention. It will be understood that the claims are intended to cover all changes and modifications of the preferred embodiments of the invention, herein chosen for the purpose of illustration which do not constitute departures from the spirit and scope of the invention.

What is claimed is:

1. An electric lamp and cooperating socket therefor comprising:

a. at least three conductive support members sealably embedded in a lamp envelope;
b. each of said support members having an inside part and an outside part;
c. said inside parts of said support members being connected to at least two electrical components;
d. mounting means formed in said outside parts;
e. socket means having at least three means for cooperative supporting and power supplying engagement with said at least three outside parts; each of said at least three means for cooperative supporting and power supplying engagement being electrically insulated from at least two others; and
f. said mounting means containing installation limiting means cooperating with the supporting means on said socket to require installation on said socket means in a single rotational orientation.

2. The lamp as recited in claim 1 wherein said installation limiting means comprises:

a. a conductive connection between at least a first and second and said outside parts forming therewith a loop; and
b. a hook in at least a third of said outside parts bent at an angle exceeding 90° normal to the plane containing said loop.

3. The lamp is recited in claim 1 wherein said installation limiting means comprises:

a. a conductive connection between at least a first and a second of said outside parts forming therewith a first loop;
b. a second and third loop formed in at least a third and fourth of said outside parts, the length of one of said second or third loops being greater than the other; and
c. the plane containing said loops being parallel to the plane containing said first loop.

4. The lamp as recited in claim 1 wherein said installation limiting means comprises:

a. a loop formed in at least four outside parts;
b. the plane of all of said loops being parallel; and
c. two of said loops being longer than the other two of said loops.

5. The lamp as recited in claim 1 wherein said installation limiting means comprises:

a. a loop formed in a first and a second outside part;
b. the plane of said loops being parallel to each other; and
c. a hook in at least a third of said outside parts bent at an angle exceeding 90° normal to the planes containing the loops.

6. An electric lamp and cooperating socket therefor as recited in claim 1 wherein said socket comprises:

a. first and second supporting and power-providing pins, said first and second pins being adjacent and parallel;
b. a horizontal shoulder on each of said first and second pins;
c. said first and second pins being electrically insulated from each other and adapted to receiving electrical power;
d. a third supporting and power-providing pin spaced away from said first and second pins;
e. said third pin being electrically insulated from said first and second pins and adapted to receiving electrical power; and
f. lamp-capturing means on said third pin.

7. A dual filament electric lamp and socket of a type wherein each filament is adapted to illumination independently of the other filament comprising:

a. two electrically heatable filaments;
b. means for supporting said two electrically heated filaments;
c. an envelope enclosing said filaments and a portion of said supporting means;
d. end portions of each supporting means protruding from said envelope;
e. means for hermetically sealing said envelope to said supporting means at the points where said supporting means pass through said envelope;
f. a socket receiving electric power from two means for connecting power;
g. at least three means on the external portion of said supporting means for mechanical and electrical connection of said lamp to said socket;
h. said socket having at least three means for cooperative supporting and power supplying engagement with said at least three outside parts; each of said at least three means for cooperative supporting and power supplying engagement being electrically insulated from at least two others; and
i. means on said socket and supporting means for requiring insertion of said lamp in said socket in one particular rotational orientation and preventing installation in at least one other orientation.

* * * * *